US009372046B2

(12) United States Patent
Albanese

(10) Patent No.: US 9,372,046 B2
(45) **Date of Patent: *Jun. 21, 2016**

(54) ACCESSORY FOR AN ARCHERY BOW

(71) Applicant: Nicola Albanese, Flemington, NJ (US)

(72) Inventor: Nicola Albanese, Flemington, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/580,372

(22) Filed: Dec. 23, 2014

(65) Prior Publication Data

US 2015/0107569 A1 Apr. 23, 2015

Related U.S. Application Data

(63) Continuation-in-part of application No. 13/559,918, filed on Jul. 27, 2012, now Pat. No. 8,955,504, which is a continuation-in-part of application No. 13/337,430, filed on Dec. 27, 2011, now Pat. No. 8,776,772.

(51) Int. Cl.
*F41B 5/14* (2006.01)

(52) U.S. Cl.
CPC ..... *F41B 5/1426* (2013.01); *F41B 5/14* (2013.01)

(58) Field of Classification Search
CPC ..... F41B 5/00; F41B 5/10; F41B 5/14
See application file for complete search history.

(56) References Cited

U.S. PATENT DOCUMENTS

| | | | | |
|---|---|---|---|---|
| 3,572,312 | A | 3/1971 | Foster | |
| 3,599,621 | A | 8/1971 | Scrobell | |
| 4,787,361 | A | 11/1988 | Vyprachticky | |
| 4,836,177 | A | 6/1989 | Williams | |
| 4,976,250 | A | 12/1990 | Jeffrey | |
| 5,137,008 | A | 8/1992 | Taylor | |
| 5,349,937 | A | 9/1994 | Burling | |
| 5,464,002 | A | 11/1995 | Lavoie et al. | |
| 5,531,211 | A | 7/1996 | Wilfong, Jr. | |
| 5,853,000 | A | 12/1998 | Torgerson | |
| 6,173,707 | B1 | 1/2001 | Howell et al. | |
| 7,748,369 | B2 | 7/2010 | Chee | |
| 7,954,175 | B2 | 6/2011 | Platt | |
| 8,646,440 | B1 | 2/2014 | Albanese | |
| 8,776,772 | B1 | 7/2014 | Albanese | |
| 8,955,504 | B1 * | 2/2015 | Albanese et al. | 124/88 |
| 2012/0174904 | A1 * | 7/2012 | Greenhoe | 124/89 |

* cited by examiner

*Primary Examiner* — John Ricci

(74) *Attorney, Agent, or Firm* — Thomas L. Adams

(57) ABSTRACT

An accessory for an archery bow and bow string that are centered on a bow plane. The accessory has a support that is attached to forearm brace and is adapted to be supported by the bow. The forearm brace extends around a forearm axis at least 90° and is sized to at least partially encompass a forearm. The brace has an opening for inserting a forearm. This opening is oriented in a direction that points outwardly without tilting toward the bow plane. The support is adapted to position at least a portion of the brace forward of the bow string when in its neutral position. An archer can grasp the bow and insert into the brace a forearm that is encompassed by the brace for at least 90°. The archer can draw and release the bow string, allowing the brace to stabilize the angle of elevation of the bow.

19 Claims, 7 Drawing Sheets

ACCESSORY FOR AN ARCHERY BOW

CROSS-REFERENCES TO RELATED APPLICATIONS

This application is a continuation-in-part and claims the benefit of U.S. patent application Ser. No. 13/559,918, filed Jul. 27, 2012, which is in turn a continuation-in-part and claims the benefit of U.S. patent application Ser. No. 13/337,430, filed Dec. 27, 2011 (now U.S. Pat. No. 8,776,772), the contents of which applications are hereby incorporated by reference herein.

BACKGROUND OF THE INVENTION

1. Field of the Invention

The present invention relates to accessories for an archery bow, and in particular, to devices for engaging the forearm of an archer.

2. Description of Related Art

An archery bow may have a substantial draw weight, that is, a substantial force required to pull the string back and fully flex the bow. This force can produce torques that change the aiming of the arrow in elevation and azimuth. Moreover, these torques will abruptly change direction at the moment the string is released to launch the arrow. For this reason, a certain amount of angular rotation of the bow can be expected and tolerated when the string is released. Specifically, when the string is released the bow normally tends to rotate in a vertical plane with its upper tip tilting forward.

Improved accuracy is achieved if the archer does not grip the bow too tightly. A tight grip tends to apply undesirable torques to the bow. In a recommended shooting method, the hand holding the bow is kept relatively open so the bow passes though the crook between the thumb and forefinger to balance primarily against the heel of the palm. This relatively open grip avoids manual torques that might tend to undesirably rotate the bow azimuthally or elevationally when aiming an arrow. Instead, the bow takes a balanced position that enhances accuracy.

Repeatability is very important for accurate shooting. Archers will try to consistently orient their bow and bow string by using anchor points. A basic anchor point is the consistent placement of the archer's extended hand on the riser. Anchors also exist for the bow string. For example, an archer may always draw the bow string back so that the thumb touches a specific place on the archer's jaw. For this same purpose, some bow strings have a kisser button, a small button on the string that is drawn back to consistently touch, for example, a corner of the archer's mouth.

Modern bows have threaded sockets for accepting a variety of accessories. For example, stabilizers in the form of cantilevered weights can be attached to the bow to balance it and to increase its moment of inertia, in order to reduce undesirable bow rotations and vibrations. Also, a string vibration arrester mounted on the bow has a rod terminating with a notched cradle for stopping a released string at a neutral position and preventing vibration.

With a compound bow the string is part of a cable system and is suspended between cams on opposite ends of the bow. When the string is pulled the cables are drawn over the cams to produce a mechanical advantage. A cable guard can be used to push the cables to the side to avoid interference with the bow string in the nock of the arrow. This cable guard can take the form of a rod screwed into a threaded socket on the bow and extending rearwardly. The affected cables can engage the guard either directly or through a slide mounted on the guard.

Any accessory attached to a bow must not interfere with the ease of use. Often, a bow must be quickly grasped and raised when hunting. A hunter does not have the time to manipulate accessories when a target suddenly comes within range.

See also U.S. Pat. Nos. 3,572,312; 3,599,621; 4,836,177; 4,976,250; 5,137,008; 5,349,937; 5,464,002; 5,531,211; 5,853,000; 6,173,707; 7,748,369; and 7,954,175.

SUMMARY OF THE INVENTION

In accordance with the illustrative embodiments demonstrating features and advantages of the present invention, there is provided an accessory for an archery bow and bow string that are centered on a bow plane. The accessory includes a forearm brace and a support. The forearm brace extends around a forearm axis at least 90° and is sized to at least partially encompass a forearm. The brace has an opening for inserting a forearm. The support is attached to the brace and is adapted to be supported by the bow. The support is adapted to position at least a portion of the brace forward of the bow string when in its neutral position, with the brace opening oriented in a direction that points outwardly without tilting toward the bow plane.

In accordance with another aspect of the invention, a method is provided that employs a forearm brace with a brace opening in connection with an archery bow and bow string. The bow and bow string are centered on a bow plane. The method includes the step of supporting the forearm brace on the bow with the brace opening oriented in a direction that points outwardly without tilting toward the bow plane. The brace is positioned to place at least a portion of the brace forward of the bow string when in its neutral position. The method also includes the step of grasping the bow and inserting into the brace a forearm that is encompassed by the brace for at least 90°. Another step is drawing and releasing the bow string, and allowing the brace to stabilize the angle of elevation of the bow.

By employing an accessory and method of the foregoing type, an archer can achieve improved accuracy. In a disclosed embodiment a C-shaped brace is supported on its periphery by a post. The post can be perpendicularly mounted on a rod that is, in turn, attached to a threaded socket on the back of the riser of the bow. This rod can be dedicated to supporting the brace or may be part of another accessory, such as a string vibration arrester or cable guard.

In one embodiment, the rod is supported on a bracket that is bolted to the front or back of a riser, which is especially useful for risers lacking a variety of threaded socket on the riser.

In this disclosed embodiments the C-shaped brace extends 240°, 180°, and 150°. The brace has beveled tips, and is sized to encircle an archer's forearm. This forearm brace is mounted in a channel at the distal end of the post. The floor of this channel is skewed so it does not lie in a plane transverse to the post axis. This skewing is designed to tip the brace closer to the archer's forearm.

The position of the disclosed brace can be adjusted. For example, the post supporting the brace can be shifted back and forth along the rod that is attached to the bow. Thus, the forearm brace can be moved closer to or farther from the archer's wrist. Also, the post can be angularly adjusted to raise and lower the forearm brace.

In the disclosed embodiment, the forearm brace can be rotated relative to the post. Specifically, the brace will have a circumferentially extending slot. A screw will extend through the slot and into a threaded hole in the floor (bearing surface) of the channel at the distal end of the post. Thus, to the extent allowed by the slot, the forearm brace can be rotated and then secured in place by tightening the screw. Accordingly, the angular position of the brace can be adjusted so it extends, for example, from the nine o'clock to five o'clock position on the forearm (from the vantage point of the archer).

When adjusted appropriately, the forearm brace rests lightly atop the archer's forearm when the bow string is drawn and the bow grip is resting against the heel of the extended hand, between the thumb and forefinger. If the extended hand inappropriately squeezes the bow, it will tip forward, lifting the forearm brace. The lifting of the brace will give the archer an indication that the grip must be changed.

Once the string is released and the arrow launched, the bow will tend to tip forward. This natural tipping will be accommodated by the forearm brace which is sufficiently open to allow unimpeded lifting of the brace and rotation of the bow.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
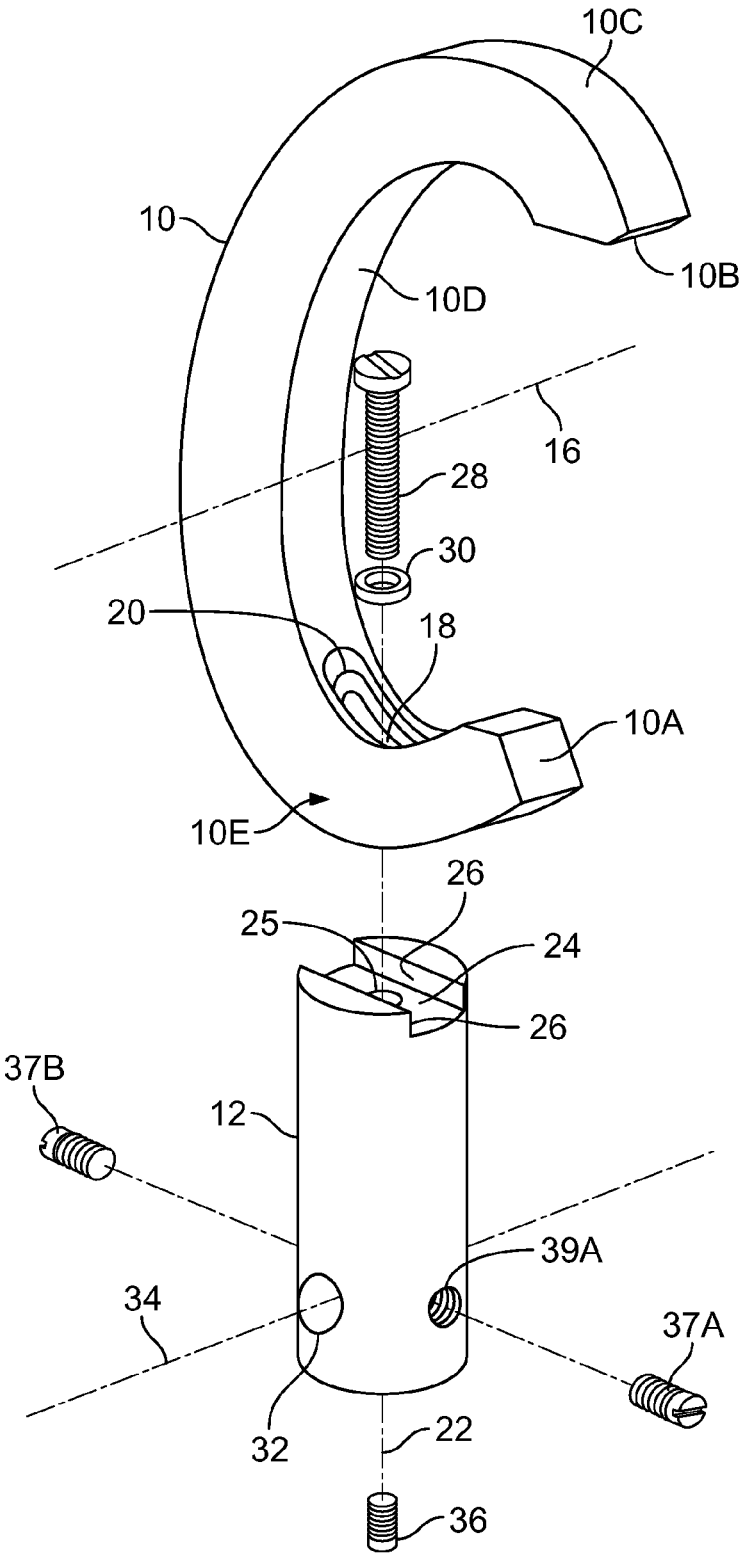
FIG. 1 is an exploded view of an accessory in accordance with principles of the present invention.
Figure 2:
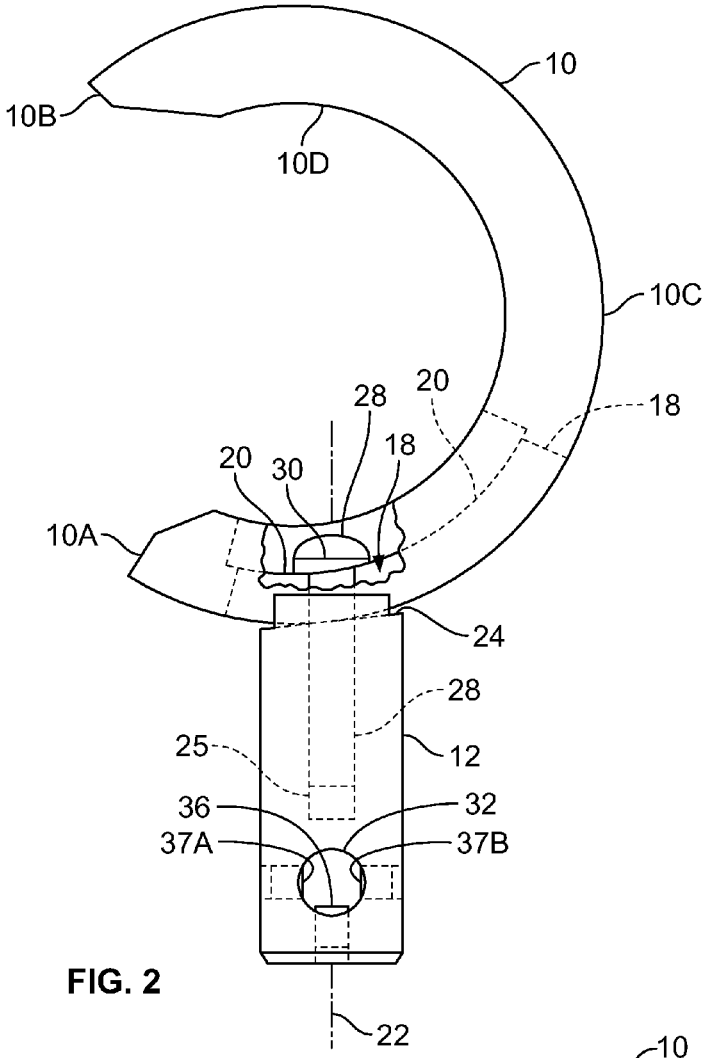
FIG. 2 is an elevational view of the device of FIG. 1, assembled.

Referring to FIGS. 1 and 2, archery bow 14 is shown with an accessory comprising forearm brace 10 mounted on support 12. Brace 10 is C-shaped and extends from bevelled tip 10A to bevelled tip 10B. Brace 10 is shown with a cylindrical inside 10D and with a cylindrical outside 10C that extends 240° around forearm axis 16, although a greater or smaller angular dimension may be employed in other embodiments. Starting approximately 15° from tip 10A, arcuate slot 18 extends circumferentially 70°. Slot 18 runs from outside 10C to inside 10D. Recess 20 on inside 10D encompasses slot 18.

Support 12 is shown as a cylindrical post with a longitudinal axis 22. The distal end of post 12 has a bearing surface 24 that is skewed approximately 7° from a plane that is perpendicular to longitudinal axis 22. Surface 24 has central threaded hole 25 and is bordered on opposite sides by parallel walls 26. Walls 26 form a channel sized to embrace forearm brace 10 at peripheral portion 10E. The wall-to-wall space of the channel is 0.5 inch (1.3 cm) and its depth is ⅛ inch (3 mm) with post 12 having a diameter of ¾ inch (1.9 cm), although these dimensions can be different in different embodiments.

In this embodiment post 12 is 2 inches (5 cm) long, but different lengths may be employed in other embodiments depending upon the bow and the archer. Also, in some embodiments, the position of the forearm brace 10 can be adjusted by choosing an appropriate post from a set of posts of different lengths.

Screw 28 can be inserted through washer 30 and slot 18 before being threaded into hole 25. As shown in FIG. 2 washer 30 has a bevelled face pressing against recess 20. The beveling of washer 30 accommodates the skewing of bearing surface 24. Washer 30 can be either molded into the illustrated shape or can be made from an elastomeric material that deforms into this shape when compressed by screw 28.

The proximal portion of post 12 has through bore 32 extending along adjustment axis 34, which axis is perpendicular to walls 26 and axis 22. In this specification support 12 is deemed divided into two contiguous portions, namely, a proximal portion containing bore 32 and a distal portion having the channel located between walls 26. The border between the proximal and distal portions is somewhat arbitrary and may be considered a division into half and half, one third and two thirds, etc.

Figure 4:
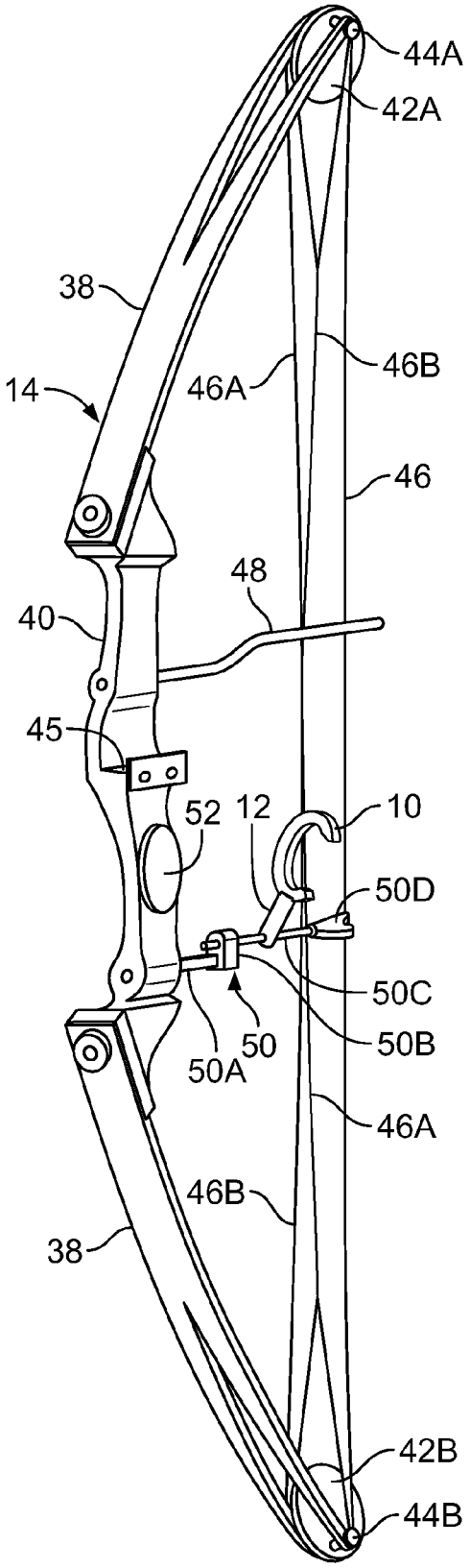
FIG. 4 is a perspective view of the device of FIG. 2 shown mounted on an archery bow.
Figure 5:
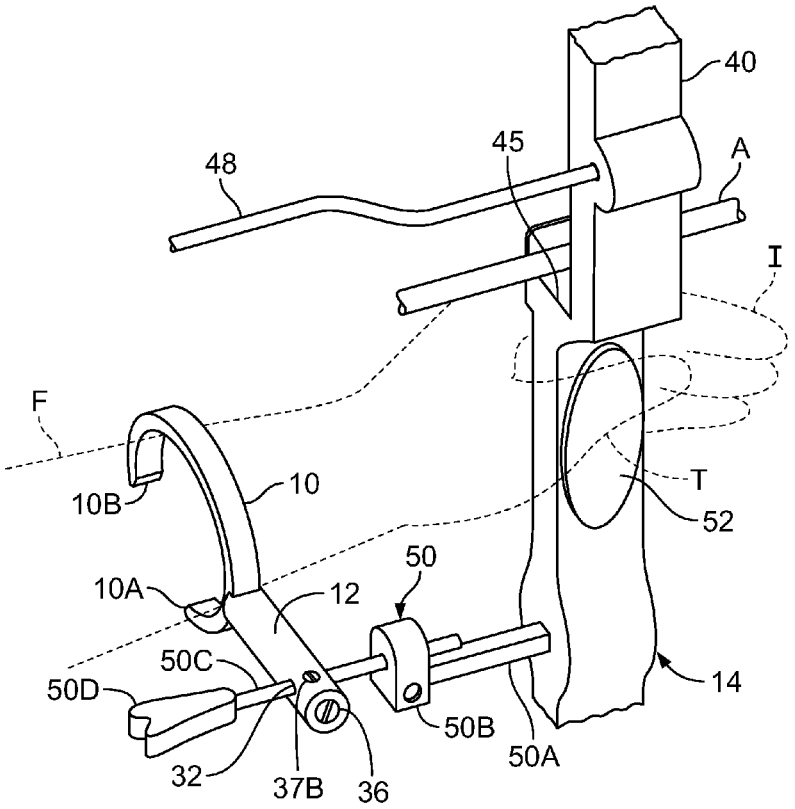
FIG. 5 is a detailed view of the assembly of FIG. 4 with portions of the bow broken away for illustrative purposes.

Referring to FIGS. 4 and 5, bow 14 has a pair of limbs 38 bolted on opposite ends of riser 40. Limbs 38 are bifurcated and rotatably support a pair of cams 42A and 42B mounted on axles 44A and 44B between the bifurcations.

Bow string 46 is routed around cava 42A and is shown descending down as cable 46A to attach through a split yoke to the ends of axle 44B. Likewise, bow string 46 is routed around cam 42B and is shown ascending as cable 46B to attach through a split yoke to the ends of axle 44A. Cable guard 48 is mounted in a threaded hole on the back of riser 40 above arrow rest 45. Guard 48 presses cables 46A and 46B to the right to avoid interference with bow string 46.

String vibration arrester 50 has a post 50A that is mounted in a threaded hole in the back of riser 40 just below hand grip 52. Clamp 50B is mounted on the distal end of post 50A and supports rod 50C. Forked rubber implement 50D is mounted on the distal end of rod 50C and is shown straddling bow string 46 in FIG. 4. Arrester 50 and guard 48 are herein referred to as rearwardly extending bow accessories.

Rod 50C is shown inserted through bore 32 of previously mentioned post 12. Rod 50C may be pulled out of clamp 50B in order to insert the rod through bore 32, before again clamping rod 50C in clamp 50B. Post 12 can linearly (axially) translate along the length of rod 50C, as well as angularly translate around the rod, before being locked into place by tightening set screws 36, 37A and 37B against rod 50C. Set screw 36 is screwed into the proximal end of post 12 through a threaded axial bore that reaches bore 32. Set screws 37A and 37B are screwed into diametrically opposed, threaded radial bores (bore 39A visible in FIG. 1) that reach bore 32. While three set screws are illustrated, some embodiments many employ one, two or another number of set screws.

To facilitate an understanding of the principles associated with the foregoing apparatus, its operation will be briefly described. An archer will grasp grip 52, placing it between thumb T and forefinger I using a relatively open grip. At the same time, the archer's forearm F will be inserted into brace 10. If brace 10 does not fit comfortably, various adjustments can be made.

To perform adjustments, set screws 36, 37A and 37B can be loosened to move brace 10 along rod 50C and thus along the length of forearm F (axial translation relative to axes 34 and 16). Also, support 12 can be rotated about rod 50C to change the elevation of brace 10 (height adjustment by means of axial translation about adjustment axis 34). In some embodiments a collection of alternate supports will be supplied that can be longer or shorter than support 12. Accordingly, an archer can select a support having a length that positions brace 10 at a desired distance from rod 50C. Alternatively, support 12 can be fabricated as a post within a larger hollow post so that the length of the support can be telescopically adjusted.

Figure 3:
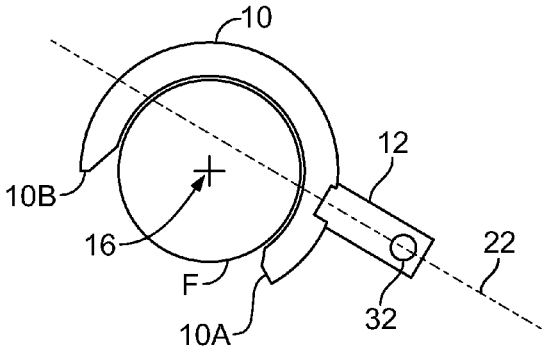
FIG. 3 is a side view of the device of FIG. 2 shown embracing an archer's forearm.

FIG. 3 shows brace 10 encircling forearm F for approximately 240°. Tip 10A is shown located at the five o'clock position and tip 10B at the nine o'clock position (viewed from the archer's vantage point). That orientation can be achieved by loosening screw 28 so it can be shifted in slot 18 in order to rotate brace 10 about axis 16 (angular translation). It will be appreciated that other orientations may be desired. In some cases the orientation may be set to extend from eight o'clock to four o'clock; 10 o'clock to six o'clock, etc. In some embodiments, brace 10 may have an angular dimension smaller than 240°, for example, 220°, 200°, 180°, or less.

Brace 10 will function as an anchor point, that is, a guide for keeping an archer's wrist and forearm in a consistent position at the time an arrow is launched. Other anchor points can also be achieved by consistent placement of the hand on the riser, as well as drawing the bow string back to a consistent position (e.g., by using a kisser button or by referencing a finger to a jaw location).

To function as an anchor point, brace 10 must clearly define a forearm/wrist location. This can be achieved when brace 10 embraces the forearm about forearm axis 16 for at least 90°. If less than 90° is encompassed the archer will not be able to reliably determine whether the forearm is centered in the brace, in which case the brace will not function as a useful anchor point. Good results are achieved if the brace 10 encompasses the forearm for about 180° or more.

Embracing the forearm over less than 180° is acceptable, especially if the radius of curvature of the forearm inside brace 10 is similar to that of the brace. With similar radii of curvature, an archer will be able to easily sense when the forearm is off-centered relative to brace 10, because the brace will feel unbalanced and will exert sharper pressure on the top or the bottom of the forearm.

In this embodiment, brace 10 has an inside diameter of 3.0 inches (7.6 cm) and an outside diameter of 4.0 inches (10 cm), although these dimensions may be varied depending upon the size of the archer's forearm F.

When held properly, riser 40 is not squeezed by the hand and instead rests in the crook between the thumb and forefinger. Accordingly, riser 40 will be able to rotate azimuthally somewhat, influenced greatly by the rearward force produced by drawing back bow string 46. At the same time, the archer's wrist should be held rigid and at a consistent angle. If this wrist angle changes, the wrist and forearm will move relative to the plane of the bow 14 and bow string 46 (bow plane), leading to inconsistent accuracy. Typically, changes in the wrist angle will correlate most closely to movement of the forearm relative to the bow plane for portions of the forearm closer to the wrist.

For this reason, good results will be achieved when all of brace 10 is located forward of the natural (undrawn) position of bow string 46. This forward location places brae 10 closer to the wrist than the elbow. Accordingly, brace 10 can act effectively as an anchor point for establishing a consistent position for the forearm and wrist angle. Also good results are achieved if all of brace 10 is at most 7 inches away from bow 14.

In contrast, locating brace 10 behind the neutral position of bow string 46 reduces effectiveness as an anchor and also causes mechanical difficulties. Bows often have at the neutral position of the bow string, a string arrestor, such as arrestor 50D of FIG. 4. Deploying long brackets to support brace 10 can interfere with brackets for supporting a string arrestor or other accessories. In fact, in the embodiment of FIG. 4 brace 10 and post 12 are supported on the arrestor rod 50C, but spaced from string arrestor 50D itself.

In addition, hardware extending beyond the neutral position of bow string 46 is cumbersome. Hunters must often quickly grasp and raise their bows when a fleeting opportunity arises to target a game animal. In such hurried situations, cumbersome hardware can snag on clothing and in general make the bow less agile. Also, with brace 10 and riser 40 closer together, they can land together in a simple fluid motion, much like slipping a hand into a large glove. When the brace 10 and riser 40 are far apart, the brace 10 must be larger to accommodate the thicker, more muscular portion of the forearm, which makes the brace assembly even more cumbersome.

In addition, such long hardware makes transportation difficult. To place the bow in a standard carrying case, the archer may need to remove the brace, which will later require reinstallation and careful alignment.

When screw 28 is tightened, outside 10C is pressed against the skewed bearing surface 24. Due to this skewing, forearm axis 16 is shifted away from longitudinal axis 22, as shown in FIG. 3. This skewing is 30° C. 15° but can be different in other embodiments. This skewing provides the advantage of bringing the brace 10 closer to forearm F. The tilting of brace 10 caused by bearing surface 24 is accommodated by washer 30, which is tapered at an angle to accommodate the skewing of the bearing surface.

In any event, brace 10 is positioned so that forearm F can be easily inserted into and removed from the brace. Insertion is through the opening in brace 10 between tips 10A and 10B, which opening faces away from the bow plane (in this specification the plane in which bow 14 and bow string 46 are centered). Ease of use can be very important when bow 14 must be quickly raised and fired by a hunter who is responding to the arrival of a target.

With string 46 drawn and arrow A nocked and placed in rest 45, significant forces and torques will be applied to bow 14. If an archer squeezes grip 52 too tightly, bow 14 will tend to rotate in a vertical plane with the top of the bow shifting forward. However, brace 10 is arranged to encompass the top of forearm F. This feature gives positive feedback to let an archer know whether an improper grip is causing rotation of bow 14. The archer will notice such rotation because brace 10 will lift from forearm F.

When bow string 46 is released and arrow A is launched, bow 14 will naturally tend to rotate in a vertical plane with the top of the bow moving forward. Brace 10 is open and therefore accommodates this natural rotation. Basically, forearm F moves out of brace 10 as the brace moves upwardly due to rotation of bow 14.

Figure 6:
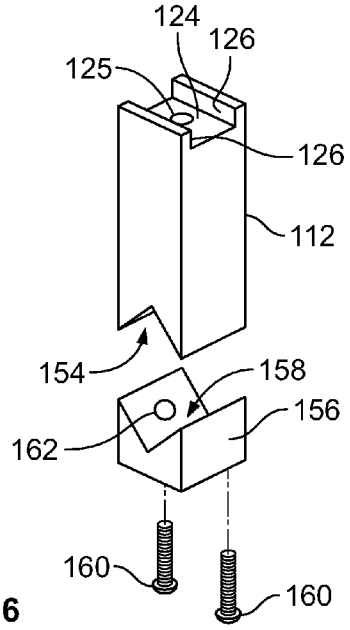
FIG. 6 is a perspective view of a support that is an alternate to that shown in FIG. 1.

Referring to FIG. 6, alternate support 112 is shown. Components corresponding to that previously illustrated for the support of FIG. 1 will bear the same reference numeral but increased by 100. Support 112 is shown as a solid rectangular prism with a V-shaped notch 154 at one end (in the proximal portion) and at the other end (in the contiguous, distal portion) a skewed bearing surface 124. Surface 124 has central threaded hole 125 and is bordered on opposite sides by parallel walls 126 and 124. Walls 26 form a channel sized to embrace forearm brace (brace 10 of FIG. 1) at peripheral portion 10E.

As before, the C-shaped brace (brace 10 of FIG. 2) can be inserted between walls 126 to bear against surface 124. The brace can be secured in place using the previously mentioned screw and washer (screw 28 and washer 30 of FIG. 2).

In this embodiment, support 112 has a clamp 156 in the form of a rectangular block with a V-shaped notch 1 facing notch 154. Clamp 156 can be secured to the body of support 112 by a pair of screws 160 that are inserted through bores 162 (only one visible in this view) before being screwed into threaded holes (not shown) in notch 154.

Previously mentioned rod (rod 50C of FIG. 5) can be inserted between notches 154 and 158 with screws 160 loosely holding clamp 156 in place. Support 112 can then be adjusted linearly and angularly before being clamped onto the rod by tightening screws 160. Notches 154 and 158 are oriented to keep the forearm axis of the brace parallel to the clamped rod.

Support 112 can be used to allow the same adjustments as previously described for the embodiment of FIG. 1. Accordingly, the brace can be positioned and used to assist an archer in the manner previously described.

Figure 8:
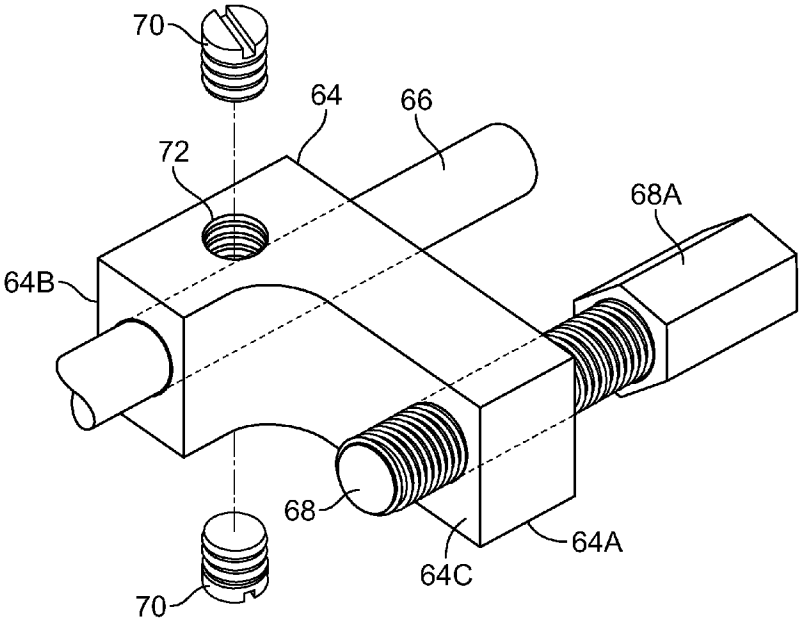
FIG. 8 is a perspective view of a portion of the support of FIG. 7.
Figure 7:
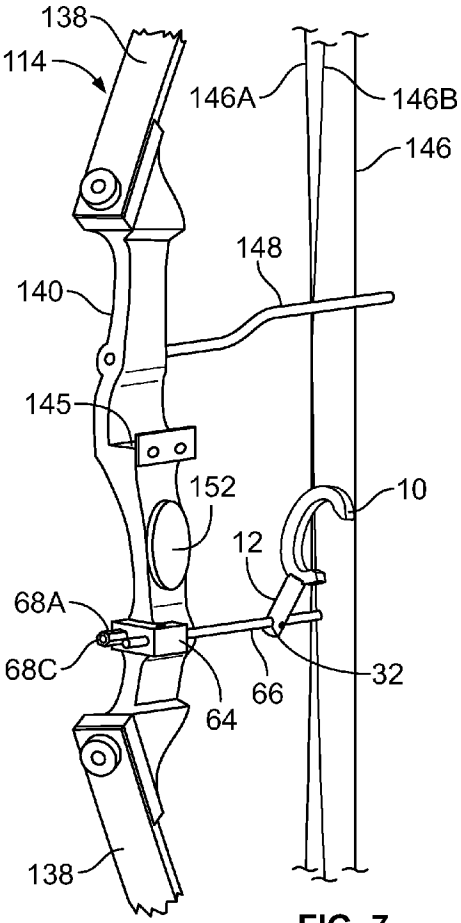
FIG. 7 is a perspective view of the forearm brace of FIG. 1 mounted on a bow with a support that is an alternate to that shown in FIG. 4.

Referring to FIGS. 7 and 8, bow 114 is similar to that previously illustrated in FIG. 4 and corresponding components have the same reference numerals but increased by 100. As before, bow 114 has a pair of limbs 138 bolted on opposite ends of riser 140. Bow string 146 is routed as before and is shown with return cables 146A and 146B.

In this embodiment, bow 114 may be an older, more traditional bow that does not have a threaded socket on the back of riser 140 to support a string vibration arrester (e.g., arrester 50 of FIG. 4). However, bow 114 has a threaded socket on the front of riser 140 originally intended to hold any one a variety of accessories (e.g., a stabilizer in the form of a cantilevered weight). Accordingly, a different support is provided herein in order to support previously mentioned forearm brace 10.

In this embodiment, the support includes not only post 12 but a fixture that comprises bracket 64 and rearwardly extending element 66. In this embodiment, bracket 64 is an L-shaped block having a proximal branch 64A and an integral, contiguous branch 64B extending transversely from the proximal branch. Proximal branch 64A has a rearwardly (inwardly) facing support surface 64C. With rearward thus defined, branch 64B is shown extending rearwardly with respect to support surface 64C.

Bolt 68 is inserted through a bore in branch 64A. With support surface 64C placed against the front of riser 140, bolt head 68A may be turned to screw the shank of bolt 68 into a threaded socket (not shown) on the front of the riser. Branch 64B is thus oriented to extend rearwardly along the left side of riser 140. It will be appreciated that this orientation is suitable for right-handed archers. For left-handed archers, bracket 64 will be rotated 180° so that branch 64B will extend rearwardly along the right side of riser 140. In either event, bracket 64 will be frontally attached to bow 114.

Bolt head 68A has a threaded socket 68C, which is arranged to support an additional accessory such as a bow stabilizer. Accordingly, bracket 64 does not detract from the ability of bow 114 to employ various accessories.

The previously mentioned element 66 is shown as a straight rod inserted in a through bore in branch 64B. Rod 66 can be longitudinally adjusted (axial adjustment along an adjustment axis 34) and then held in place by a pair of set screws 70 that are screwed into threaded holes 72 (only one hole visible in the Figures) on opposite sides of branch 64B to bear against and hold the rod in place. Rod 66 extends rearwardly from bracket 64 and is inserted through previously mentioned through bore 32 in post 12. As previously described, post 12 can be adjusted with two degrees of freedom (angular and axial) and then clamped in place.

When installed in this manner, brace 10 can be adjusted as before to embrace the archer's forearm (i.e., embrace the forearm axis). The longitudinal position of brace 10 can be adjusted by adjusting the position or rod 66 in either post 12 or bracket 64 (axial translation along the axis of rod 66). Also, brace 10 can be angularly adjusted (translated) by rotating post 12 related to the rod 66 (or by rotating rod 66 in bracket 64). After these adjustments, bow 114 and brace 10 can be used to shoot arrows in the manner previously described.

In some embodiments rod 66 can itself be adjustable. For example, an alternative rod may be telescopically arranged to allow adjustment of the length of the rod. In other embodiments the rod may be composed of a rectangular slider that slides in the channel of an extrusion having a C-shaped cross-section. The position of the slider can be fixed by using a bolt that is fastened in aligned holes or slots in the slider and extrusion.

While bracket 64 was shown as an L-shaped block, in some embodiments the bracket may be a simple rectangular block with separate bores for attachment to the riser 140 and rod 66. Alternatively, the proximal branch of the bracket can support a side branch that extends forwardly, not rearwardly. In still other embodiments the bracket may have a curved and streamlined shape. In some embodiments the bracket may have a spaced pair of collars that are connected through a spanner. In addition, the bracket can employ a variety of shapes designed to connect to various attachment points on the bow or the riser.

While the foregoing support was illustrated with three components (post 12, rod 66, and bracket 64), in some embodiments these three components will be fabricated as a single integrated unit or as a pair of separate units. In addition, instead of bolting, the support may have a clamp with jaws that grip a section of the bow or the bow's riser. In still other embodiments, the attachment may be accomplished by a bayonet connection, snap fitting, a force fitting, adhesives, welding, etc.

Figure 9:
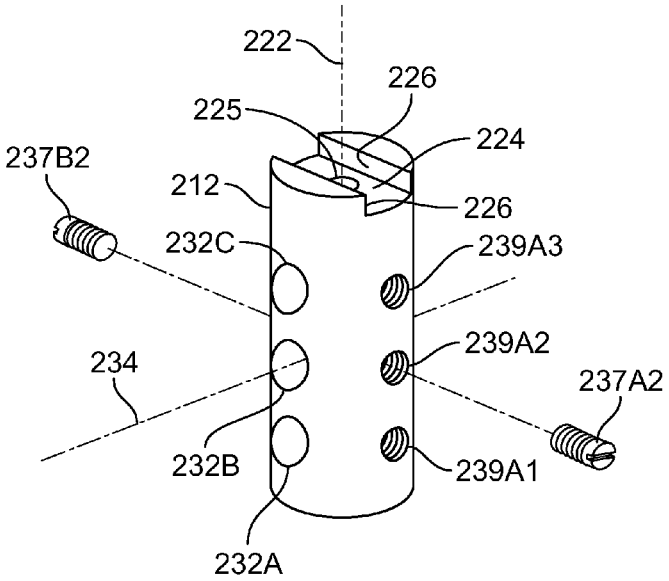
FIG. 9 is a perspective view of a post that is an alternate to that shown in FIG. 1.

Referring to FIG. 9, the illustrated post 212 is an alternative to post 12 of FIG. 1. Features of post 212 that correspond to those shown in FIG. 1 have the same reference numerals but increased by 200. Post 212 is shown as a cylindrical post with a longitudinal axis 222. The distal end of post 212 has a bearing surface 224 that is skewed approximately 7° from a plane that is perpendicular to longitudinal axis 222. Surface 224 has central threaded hole 225 and is bordered on opposite sides by parallel walls 226. Walls 226 form a channel sized to embrace the previously mentioned forearm brace (brace 10 of FIG. 1). The forearm brace will be attached to post 212 as before.

The proximal portion of post 212 has a parallel trio of equidistantly spaced through bores 232A, 232B and 232C that transversely intersect axis 222 and are perpendicular to walls 226. In this specification support 212 is deemed divided into two contiguous portions, namely, a proximal portion containing bores 232A, 232B and 232C and a distal portion having the channel located between walls 226.

Set screws 237A2 and 237B2 are screwed into diametrically opposed, threaded radial bores (bore 239A2 visible in FIG. 9) that reach bore 232B. It will be further appreciated that similar set screws (not shown) can be screwed into diametrically opposed, threaded radial bores (bores 239A1 and 239A3 visible in FIG. 9) that reach bores 232A and 232C.

Figure 10:
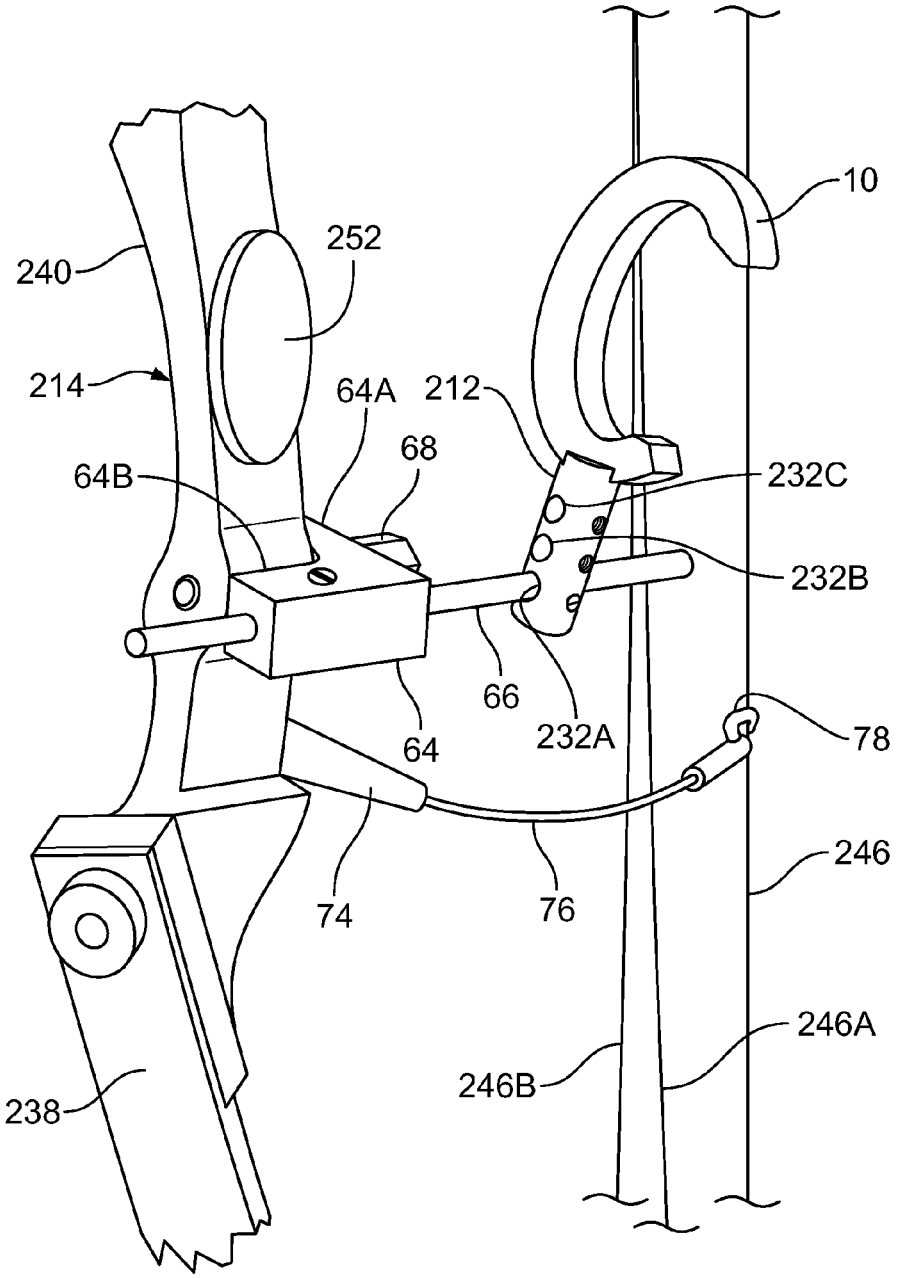
FIG. 10 is a perspective view of the post of FIG. 9 installed with the brace and bracket of FIG. 7 on a bow that is an alternate to that of FIGS. 4 and 7.

Referring to FIGS. 9 and 10, bow 214 is similar to that previously illustrated in FIG. 4 and corresponding components have the same reference numerals but increased by 200. As before, bow 214 has a pair of limbs 238 (only one visible in FIG. 10) bolted on opposite ends of riser 240. Bow string 246 is routed as before and is shown and return cables 246A and 246B.

Bow 214 may be a more modern bow with a riser 240 having a built in receptacle 74, which supports arm 76 and string vibration arrestor 78.

In this embodiment, riser 240 has on its rear face a threaded socket (not shown) to support an accessory, in this case previously mentioned bracket 64. Bracket 64 has been reversed, front to back, with proximal branch 64A placed against the back of riser 240 and branch 64B extending forwardly to the left of riser 240. Previously mentioned bolt 68 is inserted through a bore in branch 64A and screwed into the threaded socket on the back of the riser 240. As before, threaded socket 68C of bolt head 68A (FIG. 8) is arranged to support an additional accessory if desired.

It will be appreciated that this orientation is suitable for right-handed archers. For left-handed archers, bracket 64 will be rotated 180° so that branch 64B will extend forwardly along the right side of riser 140. In either event, bracket 64 will be rearwardly attached to bow 214.

The previously mentioned element 66 is shown as a straight rod inserted in a through bore in branch 64B to form a fixture. Rod 66 can be longitudinally adjusted and then held in place by a pair of set screws 70 (see FIG. 8) threaded on opposite sides of branch 64B to bear against and hold the rod in place.

Rod 66 extends rearwardly from bracket 64 and is inserted through any one of the three previously mentioned through bores 232A, 232B or 232C in post 212 to form a support for brace 10. In the example of FIG. 10, rod 66 is inserted through the bottom bore 232A, although either one of the other two bores 232B or 232C could have been used instead, depending on the preferences of the archer.

This selection of one of the three bores 232A, 232B or 232C gives another degree of freedom, namely radial adjustment along post 212 (height adjustment by means of radial translation relative to adjustment axis 34). As previously described, post 212 can also be adjusted with two other degrees of freedom (moved longitudinally and angularly about rod 66). Also, brace 10 can be shifted circumferentially on post 212 as described before. In addition, bracket 64 can be swung about bolt 68 to change the height of rod 66. After such adjustments, bow 214 and brace 10 can be used to shoot arrows in the manner previously described.

Figure 11A:
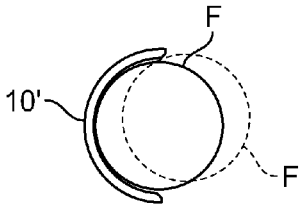
FIGS. 11A, 11B and 11C are schematic diagrams showing various forearm placements in a brace that is an alternate to that shown in FIG. 1.
Figure 11B:
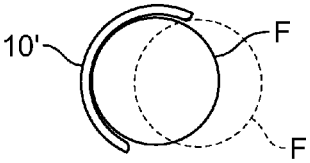
Figure 11C:
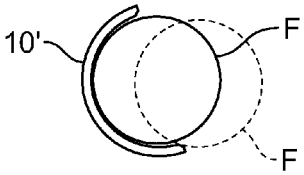

In FIGS. 11A, 11B and 11C alternative brace 10' has an arc of approximately 180°. In FIG. 11A brace 10' runs approximately between the twelve o'clock and six o'clock position; in FIG. 11B between the one o'clock and seven o'clock position and in FIG. 11C between the eleven o'clock and five o'clock position.

Brace 10' has a radius of curvature comparable to forearm F. Accordingly, forearm F rests comfortably within brace 10' when the forearm is positioned properly (as shown in full lines) and therefore the brace can be used as an anchor point. When forearm F is positioned improperly, it may reside in the location indicated by dashed lines. In FIG. 11A the archer will tend to sense sharper pressure at the top (or sometimes the bottom) of the forearm; in FIGS. 11B and 11C sharper pressure will tend to occur at the top and bottom, respectively, of the forearm F. Because the pressure is sharper, the archer will realize forearm F is not positioned properly. Besides a sharper pressure, an archer will feel that brace 10' is relatively loose.

Figure 12A:
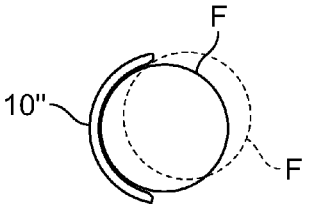
FIGS. 12A, 12B and 12C are schematic diagrams showing various forearm placements in a brace that is an alternate to that shown in the previous Figures.
Figure 12B:
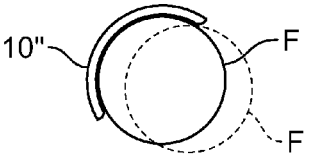
Figure 12C:
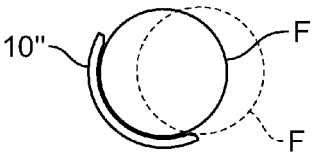

In FIGS. 12A, 12B and 12C alternative brace 10" has an arc of approximately 150°. In FIG. 12A brace 10" runs approximately between the 11:30 and 6:30 clock positions; in FIG. 12B between the one o'clock and eight o'clock position; and in FIG. 12C between the ten o'clock and five o'clock position.

Accordingly, forearm F rests comfortably within brace 10" when the forearm is positioned properly (as shown in full lines) and therefore uses the brace as an anchor point. When forearm F is positioned improperly, it may reside in the location indicated by dashed lines. In FIG. 12A the archer will tend to sense sharper pressure at the top (or sometimes the bottom) of the forearm; in FIGS. 11B and 11C sharper pressure will tend to occur at the top and bottom, respectively, of the forearm F. Besides a sharper pressure, an archer will fee that brace 10" is relatively loose.

It is appreciated that various other modifications may be implemented with respect to the above described embodiments. While a compound bow is illustrated the present invention can be applied to various other types of bows. The dimensions can be adjusted to accommodate different bows and different archers. The disclosed support and brace can be made aluminum, steel, other metals, plastics, composite materials, etc. In some cases the brace may be flexible to yield and facilitate placing the forearm into and out of the brace. In some embodiments the inside of the brace may be padded for comfort. Also, the brace need not be circular and may be curved to ergonomically engage the forearm. Instead of using a skewed bearing surface, the support may be a rod that curves toward the forearm to bring the brace closer to the forearm. In some embodiments the support may be a flexible gooseneck or may incorporate one or more universal joints that allow spatial adjustment. The support joint may be configured as an encircling hook or as a claw with opposing teeth that fit into arcuate slots on the side of the brace. Alternatively, the brace may have an arcuate, external fin that slides in a narrow slot at the end of the support; or may have an external groove that straddles a rib at the end of the support. A support was shown using a separate V block to clamp to a rod, and likewise, similar structure can be used on the opposite end of the support to clamp to the brace.

Obviously, many modifications and variations of the present invention are possible in light of the above teachings. It is therefore to be understood that within the scope of the appended claims, the invention may be practiced otherwise than as specifically described.

The invention claimed is:

1. An accessory for an archery bow and bow string that are centered on a bow plane, the accessory comprising:

a forearm brace extending around a forearm axis at least 90° and being sized to at least partially encompass a forearm, said brace having an opening that allows insertion of a forearm; and a support attached to said brace and adapted to be supported by said bow, said support being adapted to position at least a portion of said brace forward of said bow string when in its neutral position, with said opening oriented in a direction that points outwardly without tilting into said bow plane, said brace having a length measured parallel to said forearm axis, said support being adapted to position most of the length of said brace forward of said bow string when in its neutral position.

2. An accessory according to claim 1 wherein said brace extends arcuately around the forearm axis at least 180°.

3. An accessory according to claim 1 wherein said support is adapted to position all of said brace forward of said bow string when in its neutral position.

4. An accessory according to claim 1 wherein said support is adapted to position said brace so it extends at most 7 inches from said bow.

5. An accessory according to claim 1 wherein said support comprises a fixture including:

a bracket adapted to frontally attach to said bow; and a rearwardly extending element attached to said bracket.

6. An accessory according to claim 1 wherein said support comprises:

a post attached to said brace;

a bracket adapted to attach to said bow; and a rearwardly extending element attached to said bracket and said post.

7. An accessory according to claim 6 wherein said post has a through bore sized to receive said rearwardly extending element.

8. An accessory according to claim 6 wherein said post has a plurality of through bores, each sized to allow reception of said rearwardly extending element and allow adjustable placement of said rearwardly extending element along said post.

9. An accessory according to claim 6 wherein said post has a clamp adapted to be secured to said rearwardly extending element.

10. An accessory according to claim 1 wherein said forearm brace has an inside and an outside, said support being attached on the outside of said forearm brace.

11. An accessory according to claim 10 wherein said support is circumferentially repositionable along the outside of said forearm brace.

12. An accessory according to claim 1 wherein said support is adjustable to allow angular and axial translation of said forearm brace relative to an adjustment axis that is parallel to said forearm axis.

13. An accessory according to claim 1 wherein said support is adjustable to allow (a) height adjustment of said brace, (b) angular and axial translation of said brace relative to said forearm axis, and (c) angular translation of said brace relative to an adjustment axis that is parallel to and spaced from said forearm axis.

14. An accessory according to claim 1 wherein said support comprises a post having a longitudinal axis and a distal end, said post having on said distal end a bearing surface skewed relative to a plane perpendicular to said longitudinal axis.

15. An accessory for an archery bow and bow string that are centered on a bow plane, the accessory comprising:

a forearm brace extending around a forearm axis at least 90° and being sized to at least partially encompass a forearm, said brace having an opening that allows insertion of a forearm; and a support attached to said brace and adapted to be supported by said bow, said support being adapted to position at least a portion of said brace forward of said bow string when in its neutral position, with said opening oriented in a direction that points outwardly without tilting into said bow plane, said support having a fixture with a proximal branch adapted to be attached to said bow and a contiguous branch extending transversely relative to said proximal branch, said proximal branch being adapted to attach to either the front or back of said bow.

16. An accessory according to claim 15 wherein said forearm brace is rigid and C-shaped.

17. An accessory for an archery bow and bow string that are centered on a bow plane, the accessory comprising:

a forearm brace extending around a forearm axis at least 90° and being sized to at least partially encompass a forearm, said brace having an opening that allows insertion of a forearm; and a support attached to said brace and adapted to be supported by said bow, said support being adapted to position at least a portion of said brace forward of said bow string when in its neutral position, with said opening oriented in a direction that points outwardly without tilting into said bow plane, said support comprising a fixture adapted to frontally attach to said bow, said fixture having a rearwardly extending element.

18. An accessory for an archery bow and bow string that are centered on a bow plane, the accessory comprising:

a forearm brace extending around a forearm axis at least 90° and being sized to at least partially encompass a forearm, said brace having an opening that allows insertion of a forearm; and a support attached to said brace and adapted to be supported by said bow, said support being adapted to position at least a portion of said brace forward of said bow string when in its neutral position, with said opening oriented in a direction that points outwardly without tilting into said bow plane, said support comprising a bracket adapted to be attached to said bow and having a threaded socket for supporting an additional accessory.

19. A method employing a forearm brace with a brace opening in connection with an archery bow and bow string that are centered on a bow plane, the method comprising the steps of:

supporting the forearm brace on the bow with the brace opening oriented in a direction that points outwardly without tilting into said bow plane, the brace being positioned to place most of the length of the brace forward of the bow string when in its neutral position grasping the bow and inserting into the brace a forearm that is encompassed by the brace for at least 90°, and drawing and releasing the bow string, and allowing the brace to stabilize the angle of elevation of the bow.

* * * * *